US012698576B2

(12) United States Patent
Zhao et al.

(10) Patent No.: US 12,698,576 B2
(45) Date of Patent: Aug. 4, 2026

(54) COMPOSITE YARNS

(71) Applicant: SELECT (NANTONG) SAFETY PRODUCTS CO., LTD., Nantong (CN)

(72) Inventors: Wei Zhao, Shanghai (CN); Xuefeng Yan, Nantong (CN); Yuze Guan, Nantong (CN); Leilei Wu, Nantong (CN); Juan Wang, Nantong (CN); Yan Ma, Nantong (CN); Kewen Chen, Nantong (CN)

(73) Assignee: SELECT (NANTONG) SAFETY PRODUCTS CO., LTD., Nantong (CN)

( * ) Notice: Subject to any disclaimer, the term of this patent is extended or adjusted under 35 U.S.C. 154(b) by 58 days.

(21) Appl. No.: 18/607,534

(22) Filed: Mar. 17, 2024

(65) Prior Publication Data

US 2024/0218571 A1 Jul. 4, 2024

Related U.S. Application Data

(63) Continuation of application No. 18/171,294, filed on Feb. 17, 2023, now Pat. No. 11,982,023, which is a (Continued)

(30) Foreign Application Priority Data

Aug. 17, 2020 (CN) ..... 202010827636.9
Aug. 17, 2020 (CN) ..... 202010827637.3

(51) Int. Cl.
*D02G 3/04* (2006.01)
*D01H 13/06* (2006.01)
(Continued)

(52) U.S. Cl.
CPC ..... *D02G 3/04* (2013.01); *D01H 13/06* (2013.01); *D02G 3/12* (2013.01); *D02G 3/36* (2013.01);
(Continued)

(58) Field of Classification Search
None
See application file for complete search history.

(56) References Cited

U.S. PATENT DOCUMENTS 5,806,295 A 9/1998 Robins et al.
6,033,779 A 3/2000 Andrews
(Continued)

FOREIGN PATENT DOCUMENTS

CN 201343603 Y 11/2009
CN 202658288 U 1/2013
(Continued)

OTHER PUBLICATIONS

International Search Report in PCT/CN2021/112841 mailed on Sep. 26, 2021, 10 pages.
(Continued)

*Primary Examiner* — Shawn Mckinnon
(74) *Attorney, Agent, or Firm* — METIS IP LLC

(57) ABSTRACT

The embodiments of the present disclosure provide a composite yarn, comprising: a core filament located at a core of the composite yarn; a first multifilament covering in parallel a peripheral surface of the core filament; a water-based adhesive distributed on a surface and inside of the first multifilament, wherein the water-based adhesive on the surface of the first multifilament forms a water-based adhesive layer; a second multifilament covering in parallel a peripheral surface of the water-based adhesive layer; and a single-clad structure layer or a double-clad structure layer covering an outer side of the second multifilament. The
(Continued)

single-clad structure layer includes a short fiber yarn-clad structure layer or a filament-clad structure layer. The double-clad structure layer is a clad structure of short fiber yarns, a clad structure of filaments, or a clad structure of short fiber yarns and filaments. Two layers of clad yarns of the double-clad structure layer are twisted in opposite directions.

16 Claims, 9 Drawing Sheets

Related U.S. Application Data continuation-in-part of application No. PCT/CN2021/112841, filed on Aug. 16, 2021.

(51) Int. Cl.

| | |
|---|---|
| ***D02G 3/12*** | (2006.01) |
| ***D02G 3/36*** | (2006.01) |
| ***D02G 3/44*** | (2006.01) |
| ***D02J 13/00*** | (2006.01) |

(52) U.S. Cl.

CPC ..... *D02G 3/442* (2013.01); *D02J 13/001* (2013.01); *D10B 2101/20* (2013.01)

(56) References Cited

U.S. PATENT DOCUMENTS

| | | | | |
|---|---|---|---|---|
| 6,132,871 | A * | 10/2000 | Andrews | D02G 3/12 428/394 |
| 2003/0074879 | A1 | 4/2003 | Patrick | |
| 2004/0011087 | A1 | 1/2004 | Rebouillat et al. | |
| 2004/0093844 | A1 | 5/2004 | Boissonnat et al. | |
| 2004/0148921 | A1 | 8/2004 | Guevel et al. | |
| 2004/0187471 | A1 | 9/2004 | Andrews et al. | |
| 2005/0086924 | A1 | 4/2005 | Kolmes | |
| 2007/0062173 | A1 | 3/2007 | Hummel | |
| 2012/0137649 | A1 | 6/2012 | Kochmann | |
| 2016/0073713 | A1 | 3/2016 | Takata | |

FOREIGN PATENT DOCUMENTS

| | | | |
|---|---|---|---|
| CN | 104963052 | A | 10/2015 |
| CN | 105483892 | A | 4/2016 |
| CN | 106012149 | A | 10/2016 |
| CN | 207845880 | U | 9/2018 |
| CN | 208087827 | U | 11/2018 |
| CN | 110172777 | A | 8/2019 |
| CN | 112941689 | A | 6/2021 |
| CN | 112941690 | A | 6/2021 |
| EP | 0599584 | A1 | 6/1994 |
| EP | 3054040 | A1 | 8/2016 |
| WO | 2008102130 | A1 | 8/2008 |

OTHER PUBLICATIONS

Written Opinion in PCT/CN2021/112841 mailed on Sep. 26, 2021, 11 pages.

First Office Action in Chinese Application No. 202010827636.9 mailed on Mar. 24, 2022, 12 pages.

The Second Office Action in Chinese Application No. 202010827636.9 mailed on Jul. 7, 2022, 14 pages.

First Office Action in Chinese Application No. 202010827637.3 mailed on Apr. 2, 2022, 7 pages.

The Second Office Action in Chinese Application No. 202010827637.3 mailed on May 20, 2022, 8 pages.

Decision to grant a patent in Chinese Application No. 202010827637.3 mailed on Aug. 23, 2022, 3 pages.

* cited by examiner

COMPOSITE YARNS

CROSS-REFERENCE TO RELATED APPLICATIONS

This application is a continuation of U.S. application Ser. No. 18/171,294, field on Feb. 17, 2023, which is a continuation-in-part of International Patent Application No. PCT/CN2021/112841, filed on Aug. 16, 2021, which claims priority of Chinese Patent Application No. 202010827636.9, filed on Aug. 17, 2020, and Chinese Patent Application No. 202010827637.3, filed on Aug. 17, 2020, the entire contents of each of which are incorporated herein by reference.

TECHNICAL FIELD

The present disclosure relates to the technical field of composite yarn processing, and in particular to a composite yarn.

BACKGROUND

The existing composite yarns are basically realized by blending, core wrapping, plying, and covering structures. These structures are all helically entangled by twisting, which is impossible to achieve parallel and uniform layered fibers from the core layer to the outer layer. When the composite yarn is subjected to radial or axial force, the response and force of each layer of fibers are inconsistent, resulting in insufficient or limited application of the composite yarn in some product applications.

In addition, most of the existing cut protection equipment, such as cut-resistant gloves, sleeves, scarves, clothing or shoes, etc., use inorganic or organic cut-resistant filaments or single yarns or composite yarns as textile raw materials. Composite cut-resistant yarns/filaments are often used as textile raw materials for protective equipment with high requirements. Existing composite cut-resistant yarns/filaments generally use inorganic non-metallic fiber filaments such as glass fibers and basalt fibers as core filaments covered by one or more layers of other wires, or metal wires such as stainless steel fibers and tungsten wires are used as core wires covered by one or more layers of other wires.

For example, a prior patent application (CN110172777A) discloses a cut-resistant sock and a manufacturing method thereof. The cut-resistant sock is knitted from yarns. The yarns include cut-resistant yarns, and the cut-resistant yarns are mainly made of inorganic fibers such as glass fibers, quartz fibers or ceramic fibers, or metal wires such as stainless steel wires, nickel alloy wires, titanium alloy wires, manganese alloy wires, etc. as the core materials covered by organic fibers such as aramid fibers, ultra-high molecular weight polyethylene fibers or PBO fibers.

A prior patent application (US20070062173A1) discloses a composite yarn for a safety garment. The core material of the composite yarn can be a cut-resistant core of any cut-resistant material, but not limited to, polyethylene, glass fibers and metal wires, wrapped by a first cladding layer including at least one polyester fiber, and a second cladding layer of at least one fiber including a low-friction-coefficient material and wrapping the first cladding layer in an opposite twist direction to the cladding layer.

Although the cut-resistant yarns in the prior art have certain cut-resistant properties, under the same conditions, the cut-resistant properties of composite cut-resistant yarns are better than those of cut-resistant filaments or single yarns. However, there are still many problems in the composite cut-resistant yarns with metal wires or inorganic non-metallic fibers as the core yarns. For example, after the inorganic non-metallic fibers are stressed (e.g., bending, stretching, or kinking) during processing and use, the monofilament is easy to break and emerge from the cladding layer to form burrs, pricking the skin, and causing itching and irritation; after the metal wires are covered as the core wires, the metal wires are liable to be exposed when the composite yarn is bent, forming a sharp point or breaking to form a sharp fracture, which scratches the skin. Due to the poor reshaping (recovery performance) of the metal wires, the existing cut-resistant composite yarns are liable to form creases after bending, resulting in peeling between the fabric layer and the rubber coating. Besides, the cutting edge presses down on the yarns during cutting, and the blade is easy to directly impact the metal wires, and thus the surfaces of the metal wires are damaged by incision, thereby seriously reducing their cut resistance. In addition, the cut-resistant performance of the cut-resistant yarns in the prior art needs further improvement.

SUMMARY

In order to solve the above technical problems, the present disclosure provides a composite yarn. The composite yarn may be configured to solve the above-mentioned defects in the existing cut-resistant yarn.

One of the embodiments of the present disclosure provides a composite yarn, comprising: a core filament located at a core of the composite yarn; a first multifilament covering in parallel a peripheral surface of the core filament; a water-based adhesive distributed on a surface and inside of the first multifilament, wherein the water-based adhesive on the surface of the first multifilament may form a water-based adhesive layer; a second multifilament covering in parallel a peripheral surface of the water-based adhesive layer; and a single-clad structure layer or a double-clad structure layer covering an outer side of the second multifilament. The single-clad structure layer may include a short fiber yarn-clad structure layer or a filament-clad structure layer. The double-clad structure layer may be a clad structure of short fiber yarns, a clad structure of filaments, or a clad structure of short fiber yarns and filaments. Two layers of clad yarns of the double-clad structure layer may be twisted in opposite directions.

BRIEF DESCRIPTION OF THE DRAWINGS

The present disclosure will be further illustrated by way of exemplary embodiments, which will be described in detail with the accompanying drawings. These embodiments are non-limiting. In these embodiments, the same count indicates the same structure, wherein.

DETAILED DESCRIPTION

Figure 1:
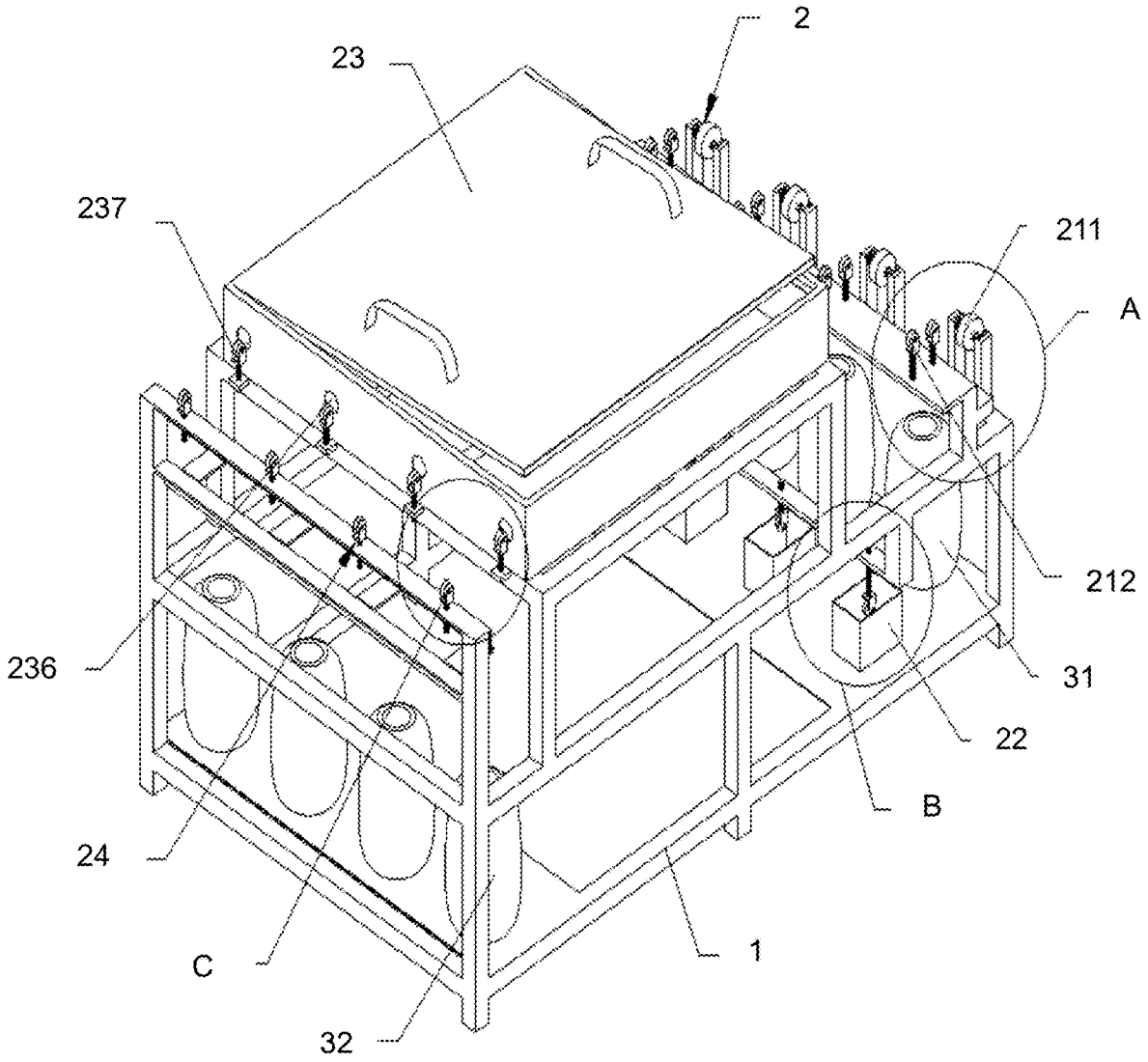
FIG. 1 is a schematic diagram illustrating an exemplary device for processing a composite yarn according to some embodiments of the present disclosure.
Figure 2:
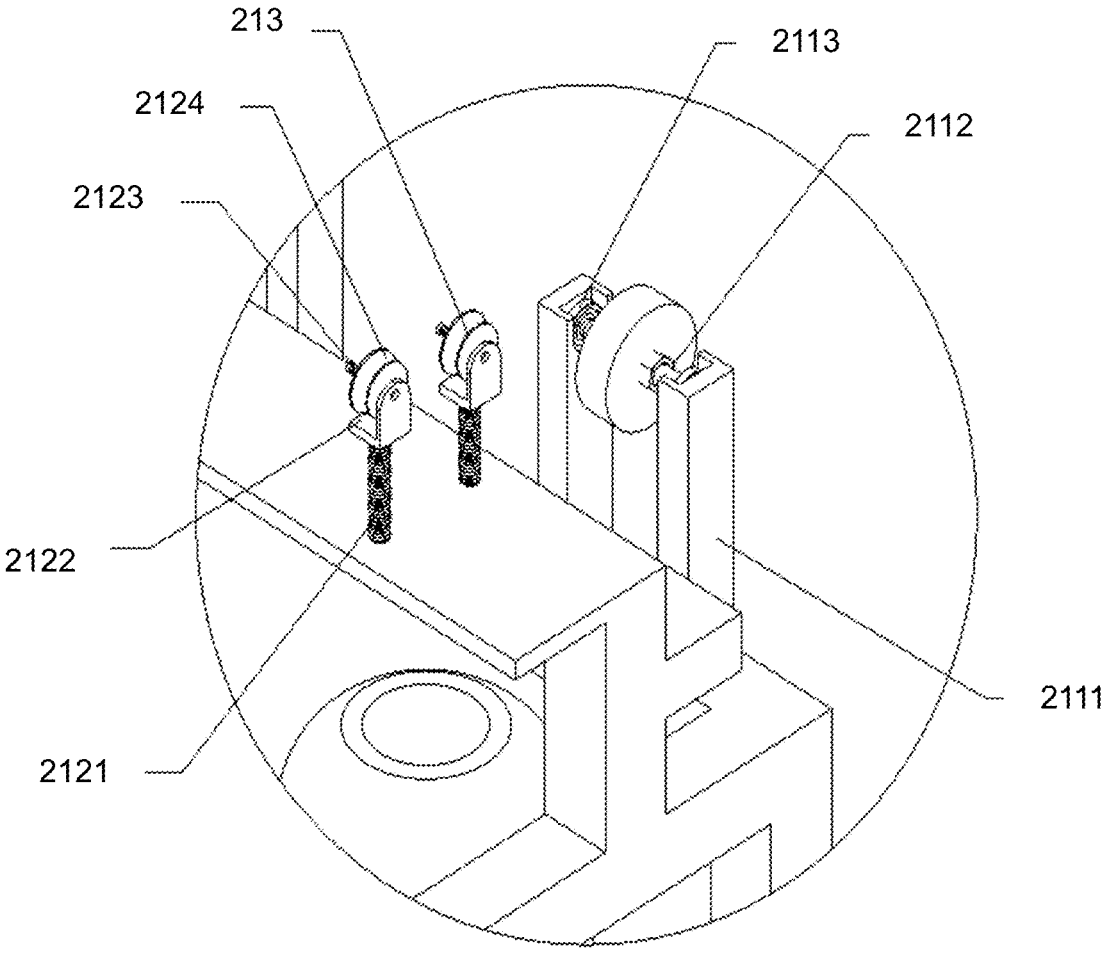
FIG. 2 is a partial enlarged view illustrating a part A in FIG. 1.
Figure 3:
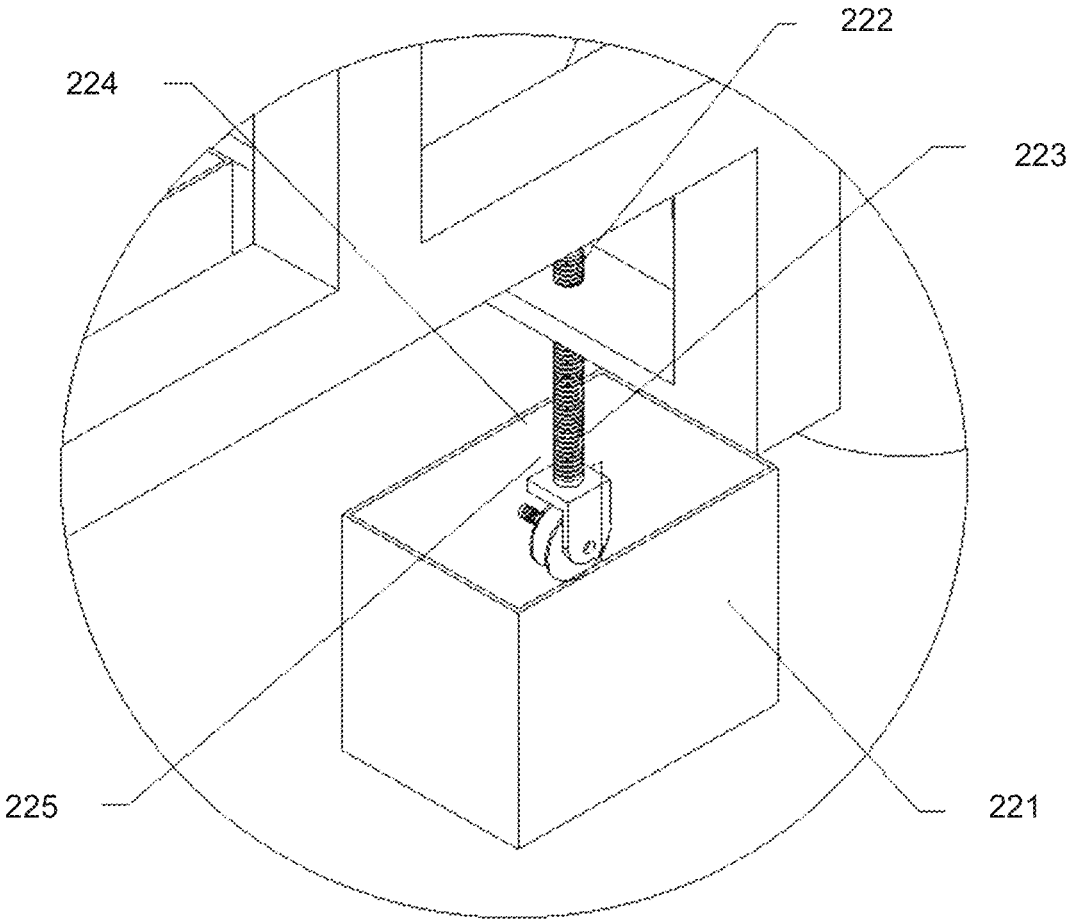
FIG. 3 is a partial enlarged view illustrating a part B in FIG. 1.
Figure 4:
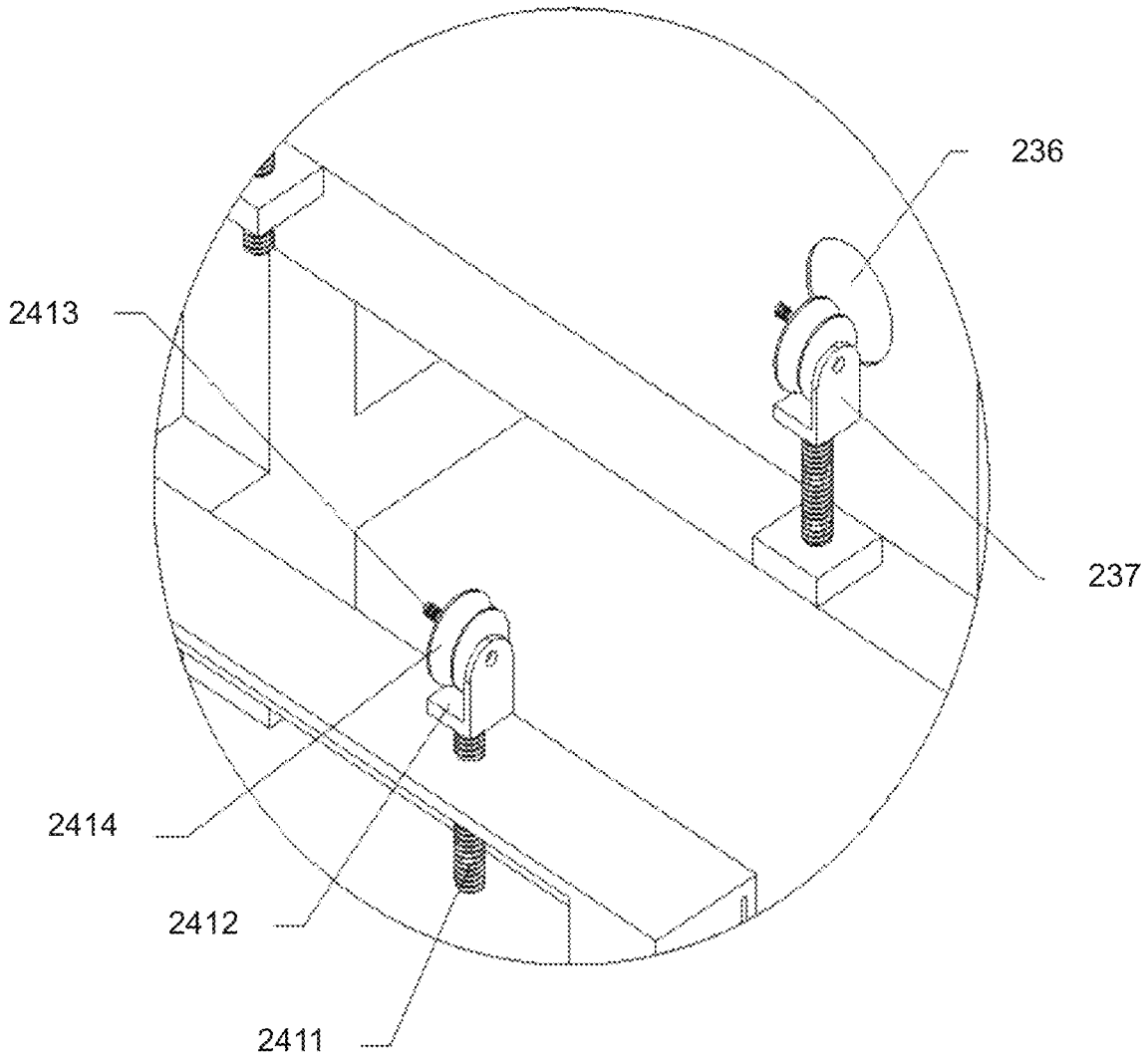
FIG. 4 is a partial enlarged view illustrating a part C in FIG. 1.
Figure 5:
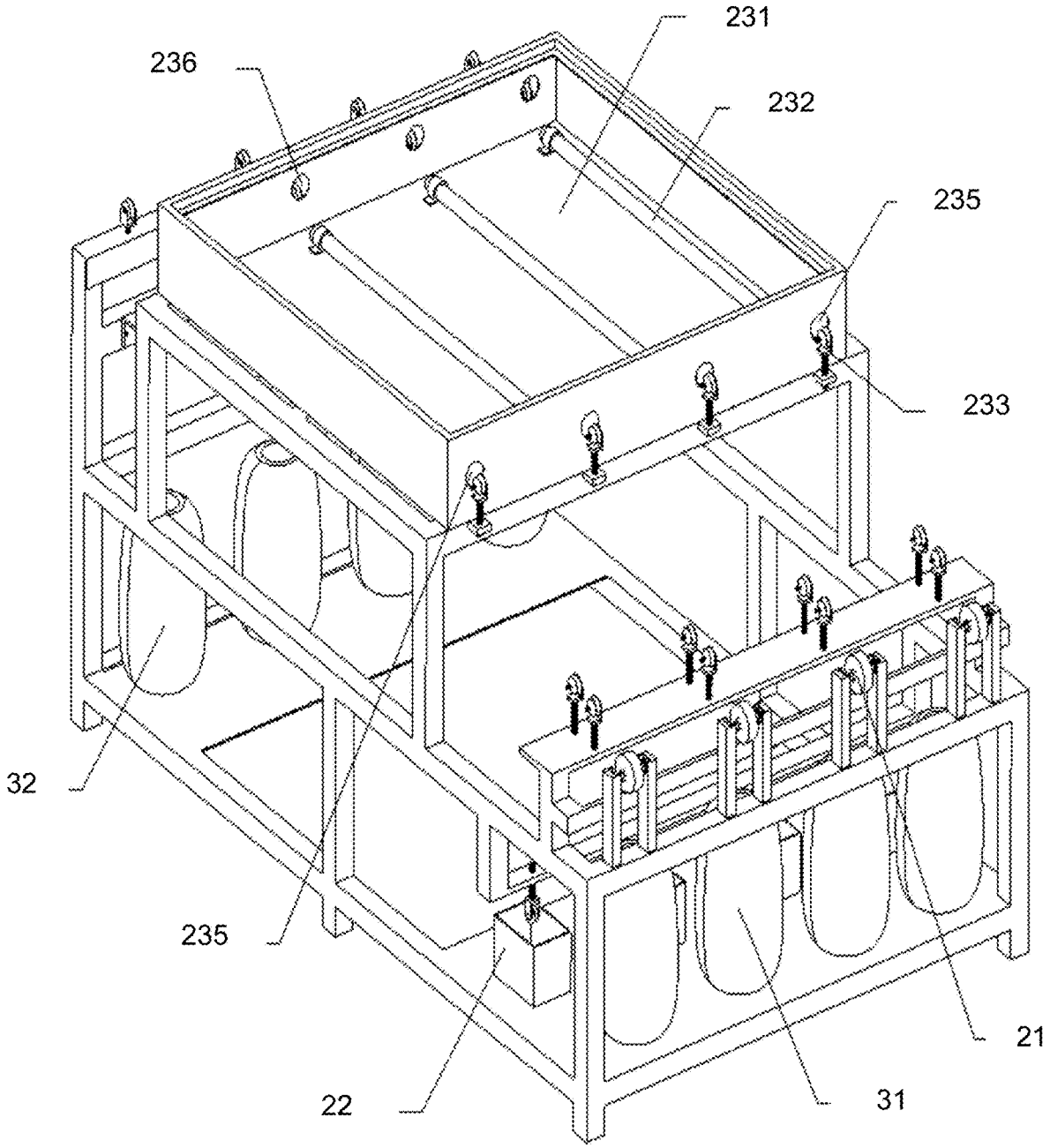
FIG. 5 is a schematic diagram illustrating an exemplary other direction of a device for processing a composite yarn according to some embodiments of the present disclosure.
Figure 6:
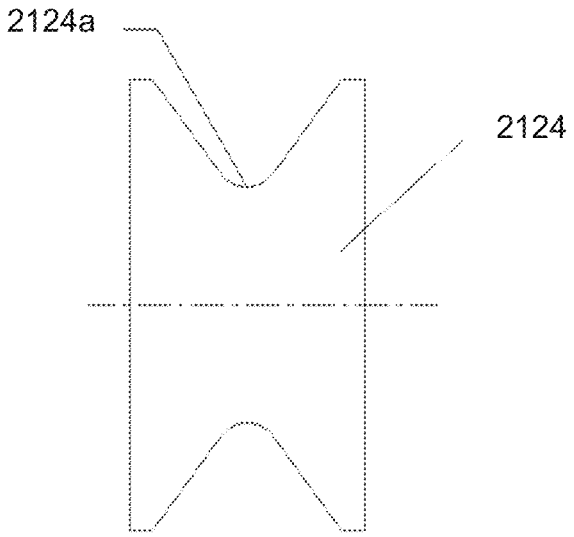
FIG. 6 is a schematic diagram illustrating an exemplary first V-shaped godet wheel of a device for processing a composite yarn according to some embodiments of the present disclosure.
Figure 7:
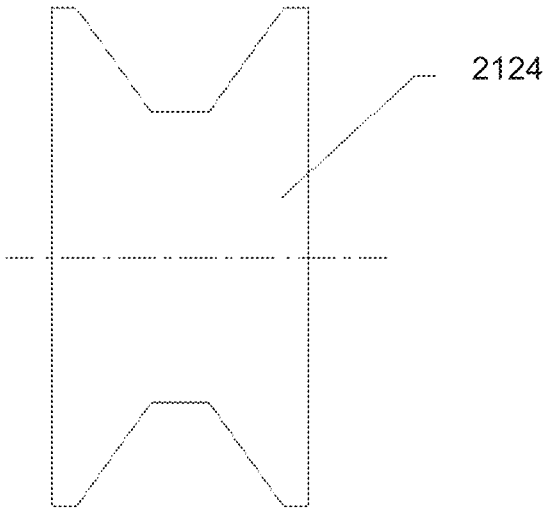
FIG. 7 is a schematic diagram illustrating another exemplary first V-shaped godet wheel of a device for processing a composite yarn according to some embodiments of the present disclosure.
Figure 8:
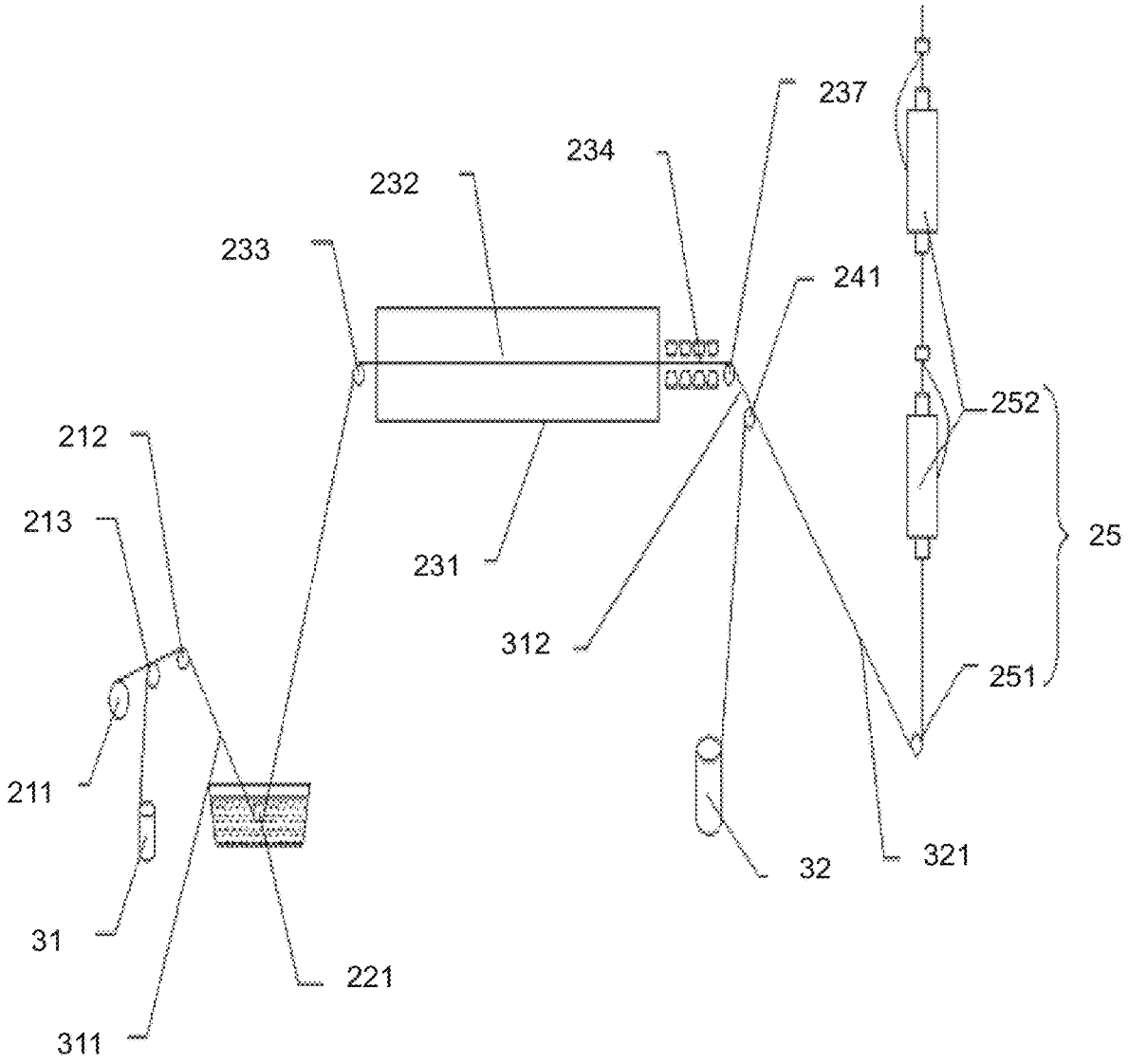
FIG. 8 is a schematic diagram illustrating principles of a device for processing a composite yarn according to some embodiments of the present disclosure.

The exemplary embodiments may be described in detail hereinafter, examples of which may be illustrated in the accompanying drawings. Where the description below relates to the accompanying drawings, the same numerals in different drawings may refer to the same or similar elements unless otherwise indicated. The following exemplary embodiments do not represent all embodiments consistent with the disclosure. Rather, they may be merely examples of devices and methods consistent with aspects of the present disclosure as recited in the appended claims.

The terminology used in the present disclosure is merely for the purpose of describing particular embodiments, and not intended to limit the disclosure. As used in the disclosure and the appended claims, the singular forms "a," "an," and "the" include plural referents unless the content clearly dictates otherwise. It should also be understood that the term "and/or" as used herein refers to and includes any or all possible combinations of one or more of the associated listed items.

It should be understood that in the description of the present disclosure, the orientation or positional relationship represented by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. is based on the orientation or positional relationship according to the drawings, and is merely for the convenience of describing the present disclosure and simplifying the description, rather than indicating or implying that the referred device or element must have a particular orientation, be constructed or operated in a particular orientation, and should not be construed as limiting the description.

In addition, the terms "first" and "second" are for descriptive purposes only, and not be interpreted as indicating or implying relative importance or implicitly specifying the quantity of indicated technical features. Accordingly, the features defined as "first" and "second" may explicitly or implicitly include at least one of the features. In the description of the present disclosure, "a plurality of" means at least two, such as two, three, etc., unless otherwise specifically defined.

In the present disclosure, the terms "installation", "connection", "fixation" and other terms should be interpreted in a broad sense unless otherwise clearly specified and limited, for example, a fixed connection, a detachable connection, or integration; a mechanical connection or an electrical connection; a direct connection or an indirect connection through an intermediary, or an internal communication between two elements or an interaction relationship between two elements, unless otherwise clearly defined. Those having ordinary skills in the art may understand the specific meanings of the above terms in the present disclosure according to specific situations.

In glass processing, metal processing, meat segmentation and other fields, there may be a greater demand for appliances with cutting damage protection. When using a composite yarn to weave cut-resistant appliances, there may be certain requirements for the cut resistance level of the composite yarn. Only when the composite yarn has excellent cut resistance, the woven protective equipment may effectively protect the human body from injury. Therefore, it is desirable to provide a composite yarn with excellent cut resistance.

In some embodiments, the present disclosure provides a composite yarn comprising a core filament located at a core of the composite yarn.

In some embodiments, the core filament may be a monofilament or a multifilament.

In some embodiments, the monofilament may be a metal monofilament, such as a stainless steel wire, a tungsten wire, or a nickel wire, or the like. In some embodiments, the monofilament may also be other metal monofilaments, such as a nickel alloy wire, a titanium alloy wire, a manganese alloy wire, or a tungsten alloy wire, or the like. In some embodiments, the monofilament may be a non-metallic monofilament, such as polyester, nylon, ultra-high molecular weight polyethylene (UHMWPE), high-strength low-elongation polyester, aramid 1414, or high-strength vinylon, or other organic fiber materials with special properties. In some embodiments, the monofilament may also be other non-metallic materials, such as an inorganic fiber, or the like. For example, the monofilament may also be materials such as a glass fiber filament, or a basalt fiber filament, or the like.

In some embodiments, the multifilament may be a metal multifilament. For example, the metal multifilament may be made of a stainless steel wire, a tungsten wire, or other materials, and may also be made of other metal materials. In some embodiments, the multifilament may also be a non-metallic material. For example, the multifilament may be made of polyester, nylon, or other organic fiber materials with special properties. In some embodiments, the multifilament may also be other non-metallic materials, such as an inorganic fiber, or the like. For example, the multifilament may be made of materials such as a glass fiber filament, or a basalt fiber filament, or the like. In some embodiments, the multifilament may also be made of metal materials and non-metallic materials. For example, the multifilament may be made of materials such as a stainless steel wire and polyester.

In some embodiments, the selection of a type and a fineness of the core filament may be considered based on a fineness, requirements for cut resistance strength, application and specification requirements, and processability of a composite yarn product. In some embodiments, the fineness of the core filament may be 5-100 μm, or the like. For example, the fineness of the metal monofilament may be generally selected within a range of 10-60 μm. Exemplarily, the stainless steel wire may select a specification within a range of 30-60 μm, the nickel wire may select a specification within a range of 20-40 μm, and the tungsten wire may select a specification within a range of 10-40 μm. As another example, the fineness of the non-metallic material may within a range of 20-100 D. The fineness of the non-metallic material may also select other fineness.

In some embodiments, the composite yarn may further comprise a first multifilament and a second multifilament. The first multifilament may cover a periphery of the core filament, and the second multifilament may be arranged on the periphery of the first multifilament.

In some embodiments, the first multifilament may cover a surface of the core filament in various ways. For example, the first multifilament may uniformly cover in parallel a peripheral surface of the core filament. The first multifilament covering in parallel a peripheral surface of the core filament may mean that a length extension direction of the first multifilament and a length extension direction of the core filament may be the same as and parallel to each other. The first multifilament uniformly may cover in parallel the peripheral surface of the core filament, which can facilitate the operation of cladding the core filament in the core after the first multifilament is stretched, and can make the first multifilament have a better effect on cladding the core filament, thereby making a better fit effect between each layer of the final composite yarn, and improving the overall strength of the composite yarn. In some embodiments, the first multifilament may also cover the surface of the core filament in other feasible ways, which is not limited herein.

In some embodiments, the composite yarn may further comprise a water-based adhesive. The water-based adhesive may cover the first multifilament in various ways such as dipping in a dipping tank, brushing, etc. For example, the water-based adhesive may cover a surface and/or inside of the first multifilament. The water-based adhesive on the surface of the first multifilament may form a water-based adhesive layer.

In some embodiments, the water-based adhesive may be selected from an environment-friendly water-based adhesive, such as water-based polyurethane emulsion or polyacrylate emulsion. A concentration of the water-based adhesive may be selected within a range of 20-50 wt %. Exemplarily, 20 wt %, 30 wt %, etc. may be selected. In some embodiments, other materials may be used as the water-based adhesive, for example, including but not limited to rubber latex, polyvinyl acetate latex, or the like.

In some embodiments, adhesion of the first multifilament to the core filament and the second multifilament may be implemented by other adhesives or other adhesion modes. For example, the adhesion of the first multifilament to the core filament and the second multifilament may be implemented based on hot melt adhesive polyethylene, nitrile rubber, or other adhesives.

In some embodiments, the second multifilament may cover a peripheral surface of the water-based adhesive layer. In some embodiments, the second multifilament may cover the surface of the water-based adhesive layer in various ways. For example, the second multifilament may uniformly cover in parallel the peripheral surface of the water-based adhesive layer. The second multifilament covering in parallel the periphery the water-based adhesive layer may mean that a length extension direction of the second multifilament and a length extension direction of the first multifilament may be the same and parallel to each other. The way of parallel cladding can make each layer of the final composite yarn have a better fit effect, and improve the overall strength of the composite yarn. In some embodiments, the second multifilament may also cover the surface of the water-based adhesive in other feasible ways, which is not limited herein.

In some embodiments, after the second multifilament cover the surface of the first multifilament, a grain orientation of constituent filaments in the second multifilament may be the same as a grain orientation of constituent filaments in the first multifilament. For example, the grain orientation of the constituent filaments in the first multifilament and the grain orientation of the constituent filaments in the second multifilament are both the same as and parallel to the length direction of the core filament. The grain orientation of the constituent filaments in the first multifilament and the grain orientation of the constituent filaments in the second multifilament may be the same, which can facilitate the operation of cladding the first multifilament after the second multifilament is stretched, and can also improve the fit degree of the second multifilament and the first multifilament to a certain extent.

In some embodiments, the grain orientation of the constituent filaments in the second multifilament and the grain orientation of the constituent filaments in the first multifilament may be different. For example, there may be a certain included angle between the grain orientation of the constituent filaments in the second multifilament and the grain orientation of the constituent filaments in the first multifilament. Merely by way of example, a value of the included angle may be within a range of 30°-90°. In some embodiments, when the grain orientation of the constituent filaments in the second multifilament and the grain orientation of the constituent filaments in the first multifilament are different, a situation that a cutting tool or other sharp tools avoid the first multifilament and the second multifilament and directly contact the core filament when cutting in from one direction can be avoided, at least one of the first multifilament and the second multifilament can be used as a barrier layer, thereby improving the cut resistance of the composite yarn.

In some embodiments, the first multifilament and the second multifilament may be composed of the same or different or partially identical materials. For example, both the first multifilament and the second multifilament may be organic multifilaments, inorganic multifilaments, or functional multifilaments. Merely by way of example, the first multifilament and the second multifilament may be a flame-retardant or high-cut-resistant multifilament, such as aramid 1313, ultra-high molecular weight polyethylene (UHMWPE), high-strength low-elongation polyester, aramid 1414, High-strength vinylon, a glass fiber, or a basalt fiber, etc.

In some embodiments, the first multifilament and/or the second multifilament may be an inorganic fiber multifilament. The inorganic fiber multifilament may cover in parallel the peripheral surface of the core filament after being stretched. In some embodiments, the inorganic fiber multifilament may select a glass fiber multifilament, a basalt fiber multifilament, or the like. In some embodiments, the inorganic fiber multifilament may also select other inorganic fibers that meet the performance requirements of a cut-resistant composite yarn product, such as an asbestos fibers, a ceramic fiber, or the like. In some embodiments, a fineness of the inorganic fiber multifilament may be controlled within a range of 50-200 D.

In some embodiments, the first multifilament and/or the second multifilament may use a high-strength and low-elongation organic multifilament. The high-strength and low-elongation organic multifilament may cover in parallel the spherical surface of the water-based adhesive layer of the first multifilament after being stretched. In some embodiments, the high-strength and low-elongation organic multifilament may be any one of ultra-high molecular weight polyethylene (UHMWPE), high-strength and low-elongation polyester, and aramid 1414. In some embodiments, the high-strength and low-elongation organic multifilament may also use other organic multifilaments that meet the performance requirements, such as high-strength vinylon. In some embodiments, a fineness of the high-strength and low-elongation organic multifilament may be within a range of 150-400 D based on product requirements and considering complete covering.

In some embodiments, the first multifilament and/or the second multifilament may be a composite filament formed by a variety of inorganic fiber multifilaments and/or high-strength and low-elongation organic multifilaments. For example, the first multifilament and/or the second multifilament may be a composite filament formed by high-strength and low-elongation polyester and aramid 1414. The first multifilament and/or the second multifilament may also be a composite filament formed by other kinds of inorganic fiber multifilaments and/or high-strength and low-elongation organic multifilaments, which is not limited herein.

In some embodiments, the core filament may be made of the metal material, the first multifilament may be made of the inorganic fiber multifilament, and the second multifilament may be made of the high-strength and low-elongation organic multifilament, i.e., an organization density of each layer of the composite yarn may tend to increase gradually from the outside to the inside, which can make the composite yarn have excellent cut resistance. The descriptions about the inorganic fiber multifilament the and high-strength and low-elongation organic multifilament may be found in the previous contents.

The high-strength and low-elongation organic multifilament with high flexibility may be arranged in the outer layer, and the inorganic fiber multifilament with higher strength may be arranged in the second outer layer, so that the composite yarn can shrink and densify from the outside to the inside under the impact of an external force to alleviate the damage of the impact shear stress to the metal fiber layer, thereby better exerting the protective effect when resisting sliding cutting, and avoiding cut resistance degradation caused by the damage incision on the surfaces of the metal wires. Besides, this design may make the composite yarn bend and deform under force as the softest organic fiber layer is arranged on the outer side. In addition, the organic fiber layer may also use its own deformation to protect the inorganic fibers and metal core filament and avoid excessive bending and breaking of the inorganic fibers exposed to form burrs that pierce the skin, thereby improving the deformation recovery ability of the metal core filament after bending, and preventing the metal core filament from bending to form sharp points or sharp fractures to scratch the skin.

In some embodiments, the composite yarn designed with the above structure may also implement that during the weaving process, the composite yarn may shrink from the outside to the inside under a tensile force, and the outer organic fibers may bear the main tensile force, which can improve the problem that inorganic fibers and the metal fibers are easy to break under the impact tensile force. In addition, the organic fiber layer may be arranged on the outer side and arranged loosely, which may be also more conducive to the penetration and adhesion of liquid colloids such as natural latex, PU glue, and nitrile latex when the surface of the composite yarn is dipped in adhesive, thereby improving the adhesion firmness.

In some embodiments of the present disclosure, the core filament of the composite yarn may be covered with the first multifilament layer and the second multifilament layer, which can improve the cut resistance of the composite yarn on a certain production cost. Compared with composite yarns with more layers of multifilaments, the composite yarn with two layers of multifilaments can be more conducive to fineness control.

The aforementioned composite yarn with a two-layer multifilament structure may be merely an example. In some embodiments, the number of layers of multifilaments may be increased or decreased adaptively. For example, a third multifilament may also be added on the surface of the second multifilament/For the cladding between the third multifilament and the second multifilament, please refer to the cladding between the second multifilament and the first multifilament. For the material selection of the third multifilament, please refer to the above-mentioned material selection of the first multifilament and the second multifilament. In some embodiments, if the composite yarn has more than two layers of multifilaments, the material selection of adjacent multifilaments may be inorganic fiber multifilaments and organic multifilaments used at intervals, thereby improving the cut resistance and the flexibility of the composite yarn.

In some embodiments, an outermost side of the composite yarn may be provided with a clad structure layer. In some embodiments, the clad structure layer may be a single-clad structure layer, a double-clad structure layer, or a multi-clad structure layer, or the like.

In some embodiments, the clad structure layer may cover an outer side of the second multifilament. In some embodiments, the clad structure layer may implement cladding by a cladding mechanism.

In some embodiments, the single-clad structure layer may be a short fiber yarn-clad structure layer or a filament-clad structure layer. In some embodiments, the double-clad structure layer may adopt various clad structures, such as a clad structure of short fiber yarns, a clad structure of filaments, or a clad structure of short fiber yarns and filaments. In some embodiments, two layers of clad yarns of the double-clad structure layer may be twisted in opposite directions. In some embodiments, the multi-clad structure layer may adopt various clad structures, such as a clad structure of short fiber yarns and filaments and short fiber yarns, or other clad structures, which is not limited herein.

In some embodiments, the short fiber yarns of the clad structure of short fiber yarns may be selected from any pure spinning yarn or any two or more blended yarns of cotton, hemp, wool, polyester, nylon, and acrylic fibers. The filaments of the clad layer of filaments may be nylon filaments and/or polyester filaments. In some embodiments, directions of the short fibers of the clad layer may vary. For example, the short fibers of the clad layer may cover an outer surface of the composite yarn in a vertical direction, and the short fibers may also cover the outer surface of the composite yarn in other directions such as a direction with an inclination angle of 60°, which is not limited herein.

In some embodiments, a fineness of the short fiber yarns may be within a range of 32-80 Ne, a twist coefficient may be within a range of 260-420, and a covering twist may be within a range of 400-800 twists/meter. In some embodiments, the fineness of the filaments may be within a range of 30-100 D, and the covering twist may be within a range of 400-800 twists/meter. In some embodiments, the fineness, the twist coefficient and the covering twist of the short fiber yarns, and the fineness and the covering twist of the filaments may also be within other ranges, which are not limited herein.

In some embodiments, the layer structure of the composite yarn may also be adaptively increased or decreased based on an application scenario of the composite yarn. For example, when the composite yarn is used in products with insulation requirements such as textile electrical gloves, an insulating layer may be arranged on an outer side of the clad structure layer of the composite yarn to improve the insulation of the composite yarn, so that the obtained protective products may prevent electric shock and arc blasts during activities involving voltage. Merely by way of example, an insulating layer made of insulating materials such as polyethylene, nylon and polyester may cover the outer side of the clad structure layer to improve the insulation of the composite yarn. For the cladding mode of the insulating layer on the clad structure layer, please refer to the cladding mode of the first multifilament or the second multifilament.

In some embodiments, a linear density of the composite yarn produced in the embodiment of the present disclosure may be within a range of 33.3 tex-72.2 tex, or other linear densities that meet the use requirements. For example, the densities of the finally obtained composite yarns in the embodiments 1-6 of the present disclosure may be 47.5 tex, 51.5 tex, 66.2 tex, 43.3 tex, 72.2 tex and 64.7 tex, respectively.

Based on the above-mentioned composite yarn, this embodiment also provides protective equipment, which may be produced by using the above-mentioned composite yarn in the present disclosure. The protective equipment may be a knitted fabric or a woven fabric. For the processing of the knitted fiber protective equipment, the composite yarn of the embodiment may be fed side by side with spandex and/or nylon filaments, and woven on a knitting machine. The model of the knitting machine may be a 7G/10G/13G/15G/18G knitting machine for weaving. As the composite yarn of the embodiment is non-elastic, the composite yarn may be fed side by side with spandex and/or nylon filaments when weaving on the knitting machine, thereby solving the problem of difficulty in weaving due to non-elasticity.

In some embodiments, composite yarns of different finenesses may also be fed side by side with spandex and/or nylon filaments respectively, and woven on the knitting machine. As the finenesses of filaments used as texile materials are different, a certain gap may be formed between each layer of an obtained multi-layer fabric (e.g., the knitted fabric or the woven fabric obtained by weaving), so that the fiber may have good cut resistance and have a certain degree of softness and heat preservation.

For the processing of woven fabric protective equipment, the composite yarn of this embodiment may be directly woven into a woven fabric with cut resistance by weaving equipment. The cut resistance of the knitted fabric or the woven fabric of this embodiment may be tested using the EN388 standard, and the cut resistance level may reach D level or above. The cut-resistant protective equipment may include but is not limited to cut-resistant gloves, sleeves, scarves, clothing or shoes.

In other embodiments of the present disclosure, a device for processing the composite yarn may be provided. As shown in FIGS. 1-8, the device for processing the composite yarn may comprise a frame 1 and a processing device 2 installed on the frame 1. The processing device 2 may be configured to produce the composite yarn. In some embodiments, one or more sets of processing devices 2 may be arranged side by side on the frame 1; each set of processing devices 2 includes a first guide composite mechanism 21 arranged at one end of the frame 1, a dipping mechanism 22 arranged below an output end of the first guide composite mechanism 21, a drying and cooling mechanism 23 arranged in a middle of the frame 1 and located downstream of the dipping mechanism, a second guide composite mechanism 24 arranged at an output end of the drying and cooling mechanism, and a cladding mechanism 25 arranged at an output end of the second guide composite mechanism 24. The aforementioned structural description is for illustrative purposes only. In some embodiments, the various mechanisms included in the processing devices 2 may also be arranged in other ways. For example, the drying and cooling mechanism 23 may be located at an end of the frame 1.

In some embodiments, when there are a plurality of sets of processing devices 2, the plurality of sets of processing devices 2 may process the composite yarn simultaneously or separately. For example, the first guide composite mechanism 21 may enable the first multifilament to cover in parallel the core filament to form a first clad filament bundle 311. The dipping mechanism 22 may feed the first clad filament bundle 311 into a dipping tank filled with the water-based adhesive for dipping treatment to obtain a composite monofilament 312. The drying and cooling mechanism 23 may cool the dipped first clad filament bundle in a dryer. The second guide composite mechanism 24 may enable the second multifilament to cover the dried and cooled composite monofilament 312 to obtain a second clad filament bundle 321. The second clad filament bundle 321 may be clad by the cladding mechanism 25 to obtain the composite yarn.

In some embodiments, the first guide composite mechanism 21 may include a first feed roller unit 211 connected with the frame 1, a first main godet wheel unit 212 arranged at an inner side of the first feed roller unit 211, and a first auxiliary godet wheel unit 213 arranged at an inlet end of the first main godet wheel unit 212. The first main godet wheel unit 212 may include a first vertical screw 2121 connected with the frame, a first L-shaped bracket 2122 connected with a top of the first vertical screw 2121, a first horizontal screw 2123 connected with the first L-shaped bracket 2122, and a first V-shaped godet wheel 2124 arranged on the first horizontal screw 2123. A guide groove of the first V-shaped godet wheel 2124 may be an arc groove **2124*a*. The arc groove 2124*a*** at a bottom of the guide groove of the V-shaped godet wheel may provide a stretching space for the first multifilament and allow the multifilament to stretch along the arc, thereby further facilitating arranging the core filament at a middle position of the stretching, to embed the core filament into the first multifilament bundle through the tension of the core filament, so that the multifilament may cover in parallel the peripheral surface of the monofilament.

In some embodiments, the structure of the first auxiliary godet wheel unit 213 may be the same as that of the first main godet wheel unit 212. The difference may lie in that a height of the first auxiliary godet wheel unit 213 may be lower than that of the first main godet wheel unit 212. The V-shaped godet wheel of the first auxiliary godet wheel unit may mainly make the first multifilament preliminarily stretch, and may have a location effect on the parallel unwinding of the core filament, so that the core filament may be located at the middle position of the stretched multifilament in response to that the guide groove of the first V-shaped godet wheel 2124 is the arc groove **2124*a*. The first feed roller unit 211 may be configured to feed a metal core filament. The first main godet wheel unit 212 may introduce the first multifilament of a first multifilament reel 31 into the first auxiliary godet wheel unit 213 for preliminary stretching, and then enter the first V-shaped godet wheel 2124 of the first main godet wheel unit 212. The arc groove 2124*a* at the bottom of the first V-shaped godet wheel 2124 may make the core filament and the first multifilament to be stretched in the arc groove 2124*a* through the tension, and the core filament may be located at the middle position of the stretched first multifilament, so that the first multifilament may cover the peripheral surface of the core filament to obtain the first clad filament bundle 311**.

In some embodiments, before the first auxiliary godet wheel unit 213, a first tension regulator (not shown in the figure) for controlling the tension of the first multifilament may be arranged on a feeding path after the first multifilament is unwound from the first multifilament reel 31 to ensure a moderate tension. Uniform stretching may be implemented after the first auxiliary godet wheel unit 213 and the first main godet wheel unit 212.

In some embodiments, a height of the first L-shaped bracket 2122 and a height the first V-shaped godet wheel 2124 may be adjusted by adjusting the first vertical screw 2121. A horizontal position of the first V-shaped godet wheel 2124 may be adjusted through the first horizontal screw 2123 to ensure that the core filament may be located at the middle position of the stretched first multifilament after being fed, which is convenient for adjustment. In some embodiments, the bottom of the first V-shaped godet wheel 2124 may also be in a shape of a trapezoidal groove, of which a bottom is flat, ensuring that the first multifilament may be stretched under tension.

In some embodiments, the first feed roller unit 211 may include a first mounting frame 2111, a first unwinding shaft 2112 arranged on the first mounting frame 2111, and damping bearings 2113 at two ends of the first unwinding shaft 2112. The tension of the core filament may be controlled and adjusted through the damping bearings. A reel of the core filament may be fixed on the first unwinding shaft 2112. In response to that the core filament is subjected to a traction force, the damping bearings 2113 may rotate to make the core filament unwound in parallel.

In some embodiments, the second guide composite mechanism 24 may include a second godet wheel unit 241 connected with the frame 1. Before the second godet wheel unit 214, a second tension regulator (not shown) for controlling the tension of the second multifilament may be arranged on a feeding path after the second multifilament is unwound from a second multifilament reel 32. For example, the structure of the second godet wheel unit 241 may the same as that of the first main godet wheel unit 212. The second godet wheel unit 241 may include a second vertical screw 2411 connected with the frame 1, a second L-shaped bracket connected with a top of the second vertical screw 2411, a second horizontal screw 2413 connected with the second L-shaped bracket 2412, and a second V-shaped godet wheel 2414 arranged on the second horizontal screw 2413. A guide groove of the second V-shaped godet wheel 2414 may be an arc groove. The arc groove may provide a stretching space for the high-strength and low-elongation organic multifilament and make the multifilament stretch along an arc surface, which may be more conducive to arranging the composite monofilament 312 at a middle position of the stretching, to embed the composite monofilament into the second multifilament through the tension of the composite monofilament, so that the multifilament bundle may cover in parallel the peripheral surface of the composite monofilament to obtain a second clad filament bundle 321.

In some embodiments, the dipping mechanism 22 may include a dipping tank 221, a third vertical screw 222 connected with the frame 1, a third L-shaped bracket 223 connected with a bottom of the third vertical screw 222, a third horizontal screw 224 connected with the third L-shaped bracket 223, and a third godet wheel 225 arranged on the third horizontal screw 224. A bottom of the third godet wheel may be located in the dipping tank 221. There may be one or more third godet wheels 225, all of which may be located in the dipping tank 221, or one of which may be located in the dipping tank 221, to ensure that the first clad filament bundle 311 is fully dipped.

In some embodiments, the structure of the third godet wheel 225 may be similar to the structure of the first may godet wheel unit 212, which is convenient for adjusting the height and the horizontal position of the third godet wheel 225. The third godet wheel 225 may be a plane wheel, or a middle part may be in a shape of a V-shaped groove or a trapezoidal groove, to ensure that the position of the first clad filament bundle 311 is not shifted during re-dipping.

In some embodiments, the drying and cooling mechanism 23 may include an oven 231, a feed port 235 arranged at one end of the oven 231 and a discharge port 236 arranged at an other end of the oven 231, a plurality of lamp tubes for drying 232 arranged in the oven 231, a feed guide wheel 233 arranged at an outer side the feed port 235, a discharge guide wheel 237 arranged at an outer side of the discharge port 236, and a cooling channel 234 (not shown in FIG. 1) arranged between the discharge port 236 and the discharge guide wheel 237. The second godet wheel unit may be located at an outlet of the cooling channel 234. Preferably, the lamp tubes for drying 232 may be infrared lamp tubes for drying.

In some embodiments, a count of the feed port 235 and the discharge port 236 and a count of the processing devices 2 may be the same, and correspond one to one. A height of the feed port 235 and the discharge guide wheel 237 arranged at the outer side of the discharge port 236 may be the same to ensure that the first clad filament bundle 311 may remain horizontal in the oven 231, and an axial distance from the first clad filament bundle 311 to the lamp tubes for drying 232 may be constant, facilitating uniform drying; preferably, the feed guide wheel 233 may be a plane wheel, which may avoid a dipping adhesive from gathering on the feed guide wheel 233; the discharge guide wheel 237 may be a common V-shaped guide wheel, which may ensure accurate location of the first clad filament bundle 311 during the guide process, and avoid deviation.

In some embodiments, a top of the oven 231 may be provided with an openable cover plate convenient for opening and closing. A temperature controller may be arranged in the openable cover plate to ensure that the temperature in the oven 231 is within a preset temperature range, and the first clad filament bundle 311 is not damaged during drying. As a preference, the cooling channel 234 may be air cooling. The second multifilament may be covered after cooling the dried first clad filament bundle 311.

In some embodiments, the cladding mechanism 25 may include a fourth godet wheel 251 arranged at an outlet of the second guide composite mechanism 24 and a cladding machine 252 arranged at an outlet of the fourth godet wheel 251. The cladding machine 252 may be a cladding machine in the prior art, and configured to obtain the composite yarn after performing single cladding or double cladding on the second clad filament bundle 321.

In some embodiments, there may be one or two or more cladding machines 252. In response to that there is one cladding machine 252, single cladding may be performed with short fiber yarns or filaments; In response to that there are two cladding machines 252, double cladding may be performed. The double-clad structure layer may be a clad structure of short fiber yarns, a clad structure of filaments, or a clad structure of short fiber yarns and filaments. Two layers of clad yarns of the double-clad structure layer may be twisted in opposite directions.

It should be noted that the foregoing descriptions about the structure of the device for processing the composite yarn are for illustrative purposes only. In some embodiments, the various components of the device for processing the composite yarn may also be implemented by other structures. For example, the first auxiliary godet wheel unit 213 and the first main godet wheel unit 212 may be combined into one godet wheel unit to be arranged at one end of the first feed roller unit 211.

In some embodiments, the structure of the device for processing the composite yarn may also increase or decrease the components based on changes in the processing technology. For example, a tension detection unit (e.g., a tension sensor) connected with the first tension regular may be additionally arranged on the first godet wheel unit 212 to detect the tension of the first multifilament. As another example, a data collection device such as an image collection device may be arranged at output ends of the processing devices 2 based on adding a quality inspection process to collect corresponding data of the produced composite yarn and perform quality inspection. As another example, in response to that the multifilament is stretched based on the arc groove, another godet wheel with the same arc groove may be arranged on the godet wheel, so that surfaces of the two godet wheels may touch each other to prevent fiber jumping. However, such modifications and alternations are still within the scope of the present disclosure.

In this embodiment, the plurality of sets of processing devices 2 may process the composite yarn simultaneously or separately. The first guide composite mechanism 21 may enable the first multifilament to cover the core filament to form the first clad filament bundle 311. The dipping mechanism 22 may feed the first clad filament bundle 311 into the dipping tank filled with the water-based adhesive for dipping treatment. The drying and cooling mechanism 23 may perform cooling treatment on the dipped first clad filament bundle through a drying machine The second guide composite mechanism 24 may enable the second multifilament to cover the dried and cooled first clad filament bundle 311 to obtain the second clad filament bundle 321. The second clad filament bundle 321 may be clad by the cladding mechanism 25 to obtain the composite yarn. Core filament feeding and first multifilament feeding of the composite yarn, first parallel covering, dipping, drying and cooling, automatic feeding of the second multifilament, second parallel covering and cladding may be implemented, to obtain the finished composite yarn.

The present embodiment provides a method for processing a composite yarn using the above-mentioned device for processing the composite yarn. A process for processing the composite yarn may include the following operations.

Step 1: a first multifilament may cover in parallel a core filament, a tension of the core filament and a tension of the first multifilament may be controlled with a first preset tension range and a second preset tension range respectively, and the core filament and the first multifilament may be introduced into a guide groove of a first godet wheel, to make the first multifilament stretch in the guide groove of the first godet wheel by the tension. The core filament may be located in a middle position the first multifilament after stretching. A first clad filament bundle in which the core filament is located at a core and the first multifilament cover in parallel a peripheral surface of the core filament may be formed after guiding of the first godet wheel.

The first preset tension range may refer to a tension range of the core filament, and the second preset tension range may refer to a tension range of the first multifilament. In some embodiments, the first preset tension range and the second preset tension range may be determined in various ways. For example, the first preset tension range and the second preset tension range may be determined based on specification parameters of the core filament and the first multifilament. The specification parameters may include at least a material type and a fineness. Merely by way of example, the first preset tension range and the second preset tension range may be determined based on a first preset data comparison table through the specification parameters of the core yarn and the first multifilament. The first preset data comparison table may record the first preset tension range and the second preset tension range corresponding to the core yarn and the first multifilament with different specification parameters under the condition that the quality of the produced composite yarn is good (e.g., satisfying a quality standard).

Merely by way of example, a process for producing the first clad filament bundle may include the following operations. The core filament and the first multifilament may be introduced into a first guide composite mechanism 21. The core filament may be first fed from a first feed roller unit 211. The first multifilament may be introduced from a first auxiliary godet wheel unit 213 to pass through a first V-shaped godet wheel of the first auxiliary godet wheel unit 213 and a first V-shaped godet wheel 2124 of a first main godet wheel unit 212 together with the core filament. The first multifilament may preliminarily stretch in an arc of the V-shaped godet wheel of the first auxiliary godet wheel unit. The first V-shaped godet wheel may locate parallel unwinding of the core filament. The first multifilament may be uniformly stretched and the core filament may be located at a middle position of the stretched inorganic fiber multifilament through the guide groove of the first V-shaped godet wheel 2124 of the first main godet wheel unit 212. A first clad filament bundle of which the core filament is located at a core and the first multifilament cover in parallel a peripheral surface of the core filament may be formed after being guided by the first main godet wheel unit 212. A reel of the core filament may be fixed on an unwinding shaft. Damping bearings may be arranged on the unwinding shaft. The tension of the core filament be controlled and adjusted by adjusting the damping bearings during the unwinding process, so that the damping bearings may rotate in response to that the core filament is subjected to a traction force, making the core filament unwind in parallel under a certain tension.

In some embodiments, the tension of the core filament may be selectively controlled with a range of 7-12 cN. A feeding tension of the first multifilament may be selectively controlled within a range of 4-6 cN on a feeding path of the first multifilament. For more descriptions about the core filament and the first multifilament, please refer to the previous related descriptions about the composite yarn.

Step 2: dipping treatment. The first clad filament bundle may be fed into a dipping tank 221, to perform dipping treatment based on dipping parameters, and then the first clad filament bundle 311 after dipping treatment may be post-processed based on post-processing parameters. In some embodiments, the dipping tank 221 may be filled with a water-based adhesive. For specific descriptions about the water-based adhesive, please refer to the previous related descriptions. The dipping parameters may include water-based adhesive parameters and dipping treatment time. The post-processing parameters may include at least a post-processing mode. The post-processing mode may include gluing or squeegeeing.

In some embodiments, the dipping treatment time may not be too short, or the amount of dipping may be too small. In response to that the time is too short, the adhesive on the first multifilament inside the composite yarn may easy to crack during use or bending. The dipping treatment time may not be too long, of the amount of adhesive carried by the first multifilament may be too high, making the final composite yarn feel too hard. In some embodiments, the dipping treatment time may be selected to be within a range of 0.5-5 s.

In some embodiments, in response to that the post-processing mode is gluing, the gluing mode of the first clad filament bundle may be implemented with a height difference greater than 0.5 m. For example, the dipping tank of the water-based adhesive may be 0.5 m lower than a feed port of an oven. A uniform adhesive film may be formed on the surface of the first clad filament bundle in a way that the water-based adhesive on the dipped filament may to fall back to the dipping tank under its own gravity during a filament gluing process, and a composite monofilament may be obtained. In the specific embodiments 1-6 of the present disclosure, the composite monofilament may be obtained by dipping and pouring adhesive.

In some embodiments, in response to that the post-processing mode is squeegeeing, the squeegeeing mode after dipping of the first clad filament bundle may be that a gauge hole may be arranged in an adhesive surface, to scrape off the excess water-based adhesive emulsion on the surface through the gauge hole after dipping of the first clad filament bundle. In some embodiments, a diameter of the gauge hole may be selected based on the fineness of the composite monofilament. For example, the diameter of the gauge hole may be set to be within a range of 30-150 μm.

Step 3: drying and cooling. The composite monofilament may be fed into the oven 231, dried based on drying parameters, and then rapidly cooled by a cold air nozzle based on the cooling parameters to obtain the composite monofilament 312.

In some embodiments, the drying parameters may include drying temperature and drying time. The cooling parameters may include cooling temperature and cooling time. In some embodiments, the drying parameters and the cooling parameters may be determined based on historical production experience. For example, the drying temperature may be within a range of 80-120° C., the drying time may be within a range of 3-6 s, and the cooling temperature may be within a range of 5-20° C. In some embodiments, the drying temperature, the drying time and the cooling temperature may also be within other numerical ranges, which are not limited herein.

Step 4: the second multifilament may cover in parallel the dried and cooled composite monofilament. A tension of the second multifilament and a tension of the dried and cooled the composite monofilament may be controlled to be within a third preset tension range and a fourth preset tension range respectively. The second multifilament and the dried and cooled composite monofilament may be introduced into an arc guide groove of the second godet wheel unit 241 of the second guide composite mechanism 24, so that the second multifilament may be stretched in the arc guide groove of the second godet wheel unit 241 under the tension. The dried and cooled composite monofilament may be located at the middle position of the stretched second multifilament, and guided by the second godet wheel unit 241 to form the second clad filament bundle 321. The second clad filament bundle 321 may have a structure of which the dried and cooled composite monofilament is located at the core and the second multifilament cover in parallel the dried and cooled composite monofilament.

The third preset tension range may refer to a tension range of the second multifilament, and the fourth preset tension range may refer to a tension range of the dried and cooled composite monofilament. For example, the third preset tension range may be within a range of 4-6 cN, and the fourth preset tension range may be within a range of 7-12 cN. In some embodiments, the third preset tension range and the fourth preset tension range may be determined based on the specification parameters of the core filament, the first multifilament and the second multifilament. In some embodiments, the specification parameters may include at least a material type and a fineness. Merely by way of example, the third preset tension range and the fourth preset tension range may be determined based on a preset data comparison table through the specification parameters of the second multifilament and the composite monofilament. The second preset data comparison table may record the third preset tension range and the fourth preset tension range corresponding to the second multifilament and the composite monofilament with different specification parameters under the condition that the quality of the produced composite yarn is good (e.g., satisfying a quality standard). For more descriptions about the third preset tension range and the fourth preset tension range, please refer to related descriptions hereinafter. For descriptions about the second multifilament, please refer to the previous descriptions about the composite yarn.

Step 5: single cladding or double cladding. The composite yarn may be obtained after performing single cladding or double cladding on the outer side of the second clad filament bundle using a cladding mechanism 25.

In some embodiments, the single cladding be implemented with short fiber yarns or filaments. A double-clad structure layer may be a clad structure of short fiber yarns, a clad structure of filaments, or a clad structure of short fiber yarns and filaments. Two layers of clad yarns of the double-clad structure layer may be twisted in opposite directions. For the specific descriptions about single cladding and double cladding, please refer to the previous descriptions about the composite yarn.

In some embodiments, the composite yarn may be implemented with a metal monofilament as the core filament, an inorganic fiber multifilament as the first multifilament, a high-strength and low-elongation organic multifilament as the second multifilament, and water-based polyurethane emulsion as the water-based adhesive. In some embodiments, the composite yarn may also be implemented with other materials. For example, the composite yarn may be implemented with a metal multifilament as the core filament, an organic fiber multifilament as the first multifilament and the second multifilament respectively, and polyacrylate emulsion as the water-based adhesive.

The surface layer of the composite yarn in the present disclosure may adopt the clad structure layer, the second outer layer may be the second multifilament, the third outer layer may be the first multifilament, and the core layer may be the core filament, so that the first multifilament may cover in parallel the core filament, and the composite monofilament may be obtained after dipping treatment. The second multifilament may uniformly cover in parallel the composite monofilament, and finally the clad structure may be adopted outside the second multifilament. The core filament, the first multifilament and the second multifilament may be selected based on the performance needs of the product. The structure of the multifilament may be uniform, and each layer (except the cladding) may uniformly cover in parallel the surface of the inner fiber layer, improving the structural stability of the composite yarn, improving the response rate and allocation effect of the fibers in each layer of structure during the stress process, and significantly improving the cut resistance.

It should be noted that the above-mentioned process for processing the composite yarn may be for illustration and description purposes only, and does not limit the scope of application of the present disclosure. Those skilled in the art may make various modifications and alterations to the process for processing the composite yarn under the guidance of the present disclosure. For example, step 1 and step 2 may be carried out simultaneously, i.e., the first multifilament covering in parallel the core filament and the dipping treatment may be carried out simultaneously, thereby reducing the feed roller unit 212 and the first auxiliary godet wheel unit 213 in FIG. 8. As another example, a tension detection device and/or a quality detection device may be added to the device for processing the composite yarn, and a tension detection process and/or a quality detection process may be added to the process for processing the composite yarn. However, such modifications and alterations are still within the scope of the present disclosure.

In some embodiments, the dipping parameters may be related to the specification parameters of the core filament and the first multifilament; the post-processing parameters may be related to the specification parameters of the core filament and the first multifilament, and the dipping parameters; the third preset tension range and the fourth preset tension range may also related to the dipping parameters, the post-processing parameters, the drying parameters and the cooling parameters.

In some embodiments, the dipping parameters may be determined in various ways. For example, first target vectors may be constructed based on the specification parameters of the core filament and the first multifilament, first correlation vectors corresponding to the first target vectors may be determined through a first vector database, and reference dipping parameters corresponding to the first correlation vectors may be determined as the dipping parameters corresponding to the first target vectors.

The first target vectors may refer to vectors constructed based on the specification parameters of the core yarn and the first multifilament. The first target vectors may be constructed in various ways. For example, the first target vectors may be obtained by inputting the specification parameters of the core filament and the first multifilament into an embedding layer for processing.

The first vector database may include a plurality of first reference vectors, and each of the plurality of first reference vectors may correspond to a correlated reference dipping parameter.

The first reference vectors may be constructed based on historical specification parameters of the core yarn and the first multifilament. The reference dipping parameters corresponding to the first reference vectors may be historical dipping parameters corresponding to the corresponding core yarn and the first multifilament. For the construction mode of the first reference vectors, please refer to the above construction mode of the first target vectors.

In some embodiments, the dipping parameters of the first target vectors may be determined by calculating distances between the first target vectors and all the first reference vectors in the first vector database. For example, the first reference vectors whose distances from the first target vectors satisfy a preset condition may be used as first correlation vectors, and the reference dipping parameters corresponding to the first correlation vectors may be used as the dipping parameters corresponding to the first target vectors. The preset condition may be set based on the situation. For example, the preset condition may be that the vector distance is the smallest or smaller than a distance threshold, or the like.

In some embodiments, the post-processing parameters may be determined in various ways. For example, second target vectors may be constructed based on the specification parameters of the core filament and the first multifilament and dipping parameters. Second correlation vectors corresponding to the second target vectors may be determined through a second vector database based on the second target vectors. Reference post-processing parameters corresponding to the second correlation vectors may be determined as the post-processing parameters corresponding to the second target vectors. For more descriptions about determining the second correlation vectors corresponding to the second target vectors through the second vector database, please refer to the above-mentioned mode of determining the first correlation vectors corresponding to the first target vectors through the first vector database.

The second target vectors may refer to vectors constructed based on the specification parameters of the core yarn and the first multifilament and the dipping parameters. For the construction mode of the second target vectors, please refer to the above construction mode of the first target vectors.

The second vector database may include a plurality of second reference vectors, and each of the plurality of second reference vectors may correspond to a correlated reference post-processing parameter.

The second reference vectors may be constructed based on historical specification parameters of the core yarn and the first multifilament and historical dipping parameters. The reference post-processing parameters corresponding to the second reference vectors may be historical post-processing parameters corresponding to the corresponding core yarn and the first multifilament. For the construction mode of the second reference vectors, please refer to the above construction mode of the first target vectors.

In some embodiments, the third preset tension range and the fourth preset tension range may be determined in various ways. For example, third target vectors may be constructed based on the specification parameters of the core yarn, the first multifilament and the second multifilament, the dipping parameters, the post-processing parameters, the drying parameters and the cooling parameters. One or more third correlation vectors corresponding to the third target vectors may be determined through a third vector database based on the third target vectors. The third preset tension range and the fourth preset tension range may be determined based on a reference third preset tension range corresponding to the one or more third correlation vectors and a reference fourth preset tension range.

For example, the currently required third preset tension range and the fourth preset tension range may be obtained by performing weighted summation or averaging on the reference third preset tension range corresponding to the plurality of third correlation vectors and the reference fourth preset tension range. For more descriptions about determining the third correlation vectors corresponding to the third target vectors through the third vector database, please refer to the above-mentioned determining mode of determining the first correlation vectors corresponding to the first target vectors through the first vector database.

The third target vectors may refer to vectors constructed based on the specification parameters of the core yarn, the first multifilament and the second multifilament, the dipping parameters, the post-processing parameters, the drying parameters and the cooling parameters. For the construction mode of the third target vectors, please refer to the above construction mode of the first target vectors.

The third vector database may include a plurality of third reference vectors, and each of the plurality of third reference vectors may correspond to a correlated reference third preset tension range and a reference fourth preset tension range.

The third reference vectors may be constructed based on historical disclosure parameters of the core yarn, the first multifilament, and the second multifilament, historical dipping parameters, historical post-processing parameters, historical drying parameters, and historical cooling parameters. A reference third preset tension range corresponding to the third reference vectors may be a historical third preset tension range corresponding to the second multifilament. A reference fourth preset tension range corresponding to the third reference vectors may be a historical fourth preset tension range corresponding to the composite monofilament formed by drying and cooling of the corresponding core filament and the first multifilament. For the construction mode of the third reference vectors, please refer to the above construction mode of the first target vectors.

In some embodiments of the present disclosure, by correlating the relevant parameters of the subsequent process with the specification parameters of the raw materials and the relevant parameters of each previous process, the finally determined dipping parameters, the post-processing parameters, the third preset tension range and the fourth preset tension range may be more reasonable, thereby improving the cut resistance of the composite yarn.

In some embodiments, in response to that the currently required third preset tension range and the fourth preset tension range are obtained by performing weighted summation on the reference third preset tension range and the reference fourth preset tension range corresponding to the plurality of correlation vectors, a weight of each correlation vector may be determined based on an abnormal correlation distance corresponding to each correlation vector during weighting. For example, the smaller the abnormal correlation distances corresponding to the correlation vectors are, the smaller the weights corresponding to the correlation vectors may be during weighted averaging. The abnormal correlation distance may be used to reflect a time interval between a time corresponding to the correlation vector and a time of a latest abnormal accident. For more descriptions about the abnormal correlation distance, please refer to the related descriptions hereinafter.

In some embodiments of the present disclosure, the weight of each correlation vector during weighting may determined by the abnormal correlation distance corresponding to each correlation vector, which is conducive to improving the rationality of the third preset tension range and the fourth preset tension range, and making the quality of the produced composite yarn better.

In the preferable embodiment of the present disclosure, the guide groove of the first godet wheel in the step 1 and the guide groove of the second godet wheel in step 4 may adopt a guide groove of a V-shaped godet wheel with an arc bottom, so that in response to that the first multifilament and the second multifilament are stretched, the arc at the bottom of the guide groove of the V-shaped godet wheel may provide a stretching space and make the multifilament stretch along the arc surface, the core filament or the composite monofilament may be arranged at the middle position of the stretching, and the multifilament may cover in parallel the outer surface of the monofilament.

In some embodiments, during the cladding process of the step 1 and/or step 4, a real-time tension of a preset time period may be obtained through one or more force sensors deployed in the processing device; a real-time tension sequence may be constructed based on the real-time tension of the preset time period obtained through the force sensor in real time; an abnormality of the cladding process may be determined based on the real-time tension sequence; safety processing may be performed in response to that the abnormality of the cladding process satisfies an abnormality condition.

In some embodiments, the force sensor may obtain the real-time tension within the preset time period in various ways. For example, the force sensor may obtain real-time tension data by obtaining tension data every interval of a collection time threshold within the preset time period. Wherein, the collection time threshold may be set in advance. For example, the force sensor may obtain 10 real-time tension data within a preset time period of 2 seconds by obtaining tension data every 0.2 second.

The real-time tension sequence may refer to a sequence used to reflect real-time tension features of the preset time period. For example, the real-time tension sequence may be (a1, a2, a3 . . . ). a1, a2, and a3 may be the real-time tension data collected by the force sensor at different times.

In some embodiments, the real-time tension sequence may be constructed in various ways. For example, the real-time tension sequence may be obtained by inputting the real-time tension of the preset time period into an embedding layer.

The abnormality of the cladding process may refer to a probability of an abnormal failure in the cladding process. The abnormality of the cladding process may be represented by a real number between 0-1. The larger the value is, the greater the probability of an abnormal failure during the cladding process may be.

In some embodiments, the abnormality of the cladding process may be determined in various ways. For example, a tension threshold may be preset. In response to that there is real-time tension data greater than the tension threshold in the real-time tension sequence, the process corresponding to the real-time tension sequence may have a high abnormality of the cladding process. The greater the amount of the real-time tension data greater than the tension threshold is, the greater the abnormality of the cladding process may be.

In some embodiments, the abnormality of the cladding process may be determined by processing the real-time tension sequence through an abnormality determination model. For more descriptions about determining the abnormality of the cladding process through the abnormality determination model, please refer to the related descriptions hereinafter.

In some embodiments, an abnormality condition may be that the abnormality of the cladding process is greater than the abnormality threshold, or the like. Safety processing may be temporary shutdown of the device for processing the composite yarn, or sending early warning information to production personnel, etc.

In some embodiments of the present disclosure, the abnormality of the cladding process may be determined by obtaining the real-time tension data using the force sensor, and safety processing may be performed based on the abnormality of the cladding process, thereby effectively improving the quality and product qualification rate of the produced composite yarn produced, and avoiding the waste of production raw materials caused by unreasonable process parameters, or other reasons.

In some embodiments, different positions in the guide slot may have different tension thresholds. The tension thresholds of different positions may be determined based on various methods. For example, the tension thresholds of different positions in the guide groove may be empirically determined based on historical data. Merely by way of example, the number of abnormal accidents such as wire breakage at each position in the guide groove may be counted based on historical abnormal accident data, and the tension thresholds corresponding to the position with more abnormal accidents may be set smaller.

In some embodiments of the present disclosure, different tension thresholds may be set at different positions of the guide grooves, so that the tension thresholds can be set more reasonably, and the accuracy of determining the subsequent abnormality of the cladding process can be improved.

In some embodiments, the abnormality of the cladding process may be determined by processing the real-time tension sequence based on an abnormality determination model.

The abnormality determination model may be a machine learning model used to determine the abnormality of the cladding process. For example, the abnormality determination model may include one of a neural network model, a convolutional neural network model, etc., or any combination thereof.

In some embodiments, an input of the abnormality determination model may include the real-time tension sequence; and an output of the abnormality determination model may include the abnormality of the cladding process of a process corresponding to the real-time tension sequence. For more descriptions about the real-time tension sequence and the abnormality of the cladding process, please refer to the related descriptions above.

In some embodiments, the abnormality determination model may be obtained through training with a plurality of labeled training samples. For example, a plurality of labeled training data may be input into an initial abnormality determination model, a loss function may be constructed through labels and an output of the initial abnormality determination model, and parameters of the initial abnormality determination model may be iteratively updated based on the loss function. In response to that the loss function of the initial abnormality determination model satisfies a preset condition, the model training may be completed, and a trained abnormality determination model may be obtained. The preset condition may be that the loss function converges, the number of iterations reaches a threshold, or the like.

In some embodiments, the training samples may include a historical real-time tension sequence of a historical preset time period corresponding to any historical time. The labels may include a historical abnormality of cladding process of a historical process corresponding to the historical real-time tension sequence. The labels of the training samples may be determined based on abnormal correlation distances of the training samples.

The abnormal correlation distance may refer to a time interval between a time when a latest abnormal accident occurs and a historical preset time period corresponding to the training sample after the historical preset time period corresponding to the training sample. For example, the historical preset time period corresponding to the training sample may be t0-t1, and after the time t1, a time when a latest abnormal accident occurs may be t2, and the abnormal correlation distance may be k(t2−t1), where k is a positive number.

In some embodiments, the smaller the abnormality correlation distance is, the greater the abnormality of the historical cladding process of the historical process corresponding to the historical real-time tension sequence my be, i.e., the greater the label corresponding to the training sample may be.

In some embodiments of the present disclosure, the abnormality of the cladding process may be determined by processing the real-time tension sequence through the abnormality determination model, thereby improving the accuracy and efficiency of the process of determining the abnormality of the cladding process, shortening the production time, and facilitating subsequent improvement of the product quality.

The composite yarn processed by the device for processing the composite yarn and specific processing technology thereof may be described hereinafter through specific product application examples. The water-based adhesives used in embodiments 1-6 may be water-based polyurethane emulsions.

Example 1 (1 #)

A composite yarn may be produced using a 20 μm tungsten wire as a core filament, a 100 D glass fiber as an inorganic multifilament, and a 200 D ultra-high molecular weight polyethylene (UHMWPE) multifilament as an organic multifilament based on the process and parameters in Table 1 and Columns 2-5 of Table 1 (continued).

Example 2 (2 #)

A composite yarn may be produced using a 25 μm tungsten wire as a core filament, a 100 D glass fiber as an inorganic multifilament, and a 200 D ultra-high molecular weight polyethylene (UHMWPE) multifilament as an organic multifilament based on the process and parameters in Table 1 and Columns 2-5 of Table 1 (continued).

Example 3 (3 #)

A composite yarn may be produced using a 30 μm tungsten wire as a core filament, a 200 D basalt fiber as an inorganic multifilament, and a 200 D ultra-high molecular weight polyethylene (UHMWPE) multifilament as an organic multifilament based on the process and parameters in Table 1 and Columns 2-5 of Table 1 (continued).

Example 4 (4 #)

A composite yarn may be produced using a 10 μm tungsten wire as a core filament, a 100 D aramid 1414 multifilament as an inorganic multifilament, and a 200 D aramid 1414 multifilament as an organic multifilament based on the process and parameters in Table 1 and Columns 2-5 of Table 1 (continued).

Example 5 (5 #)

A composite yarn may be produced using a 60 μm stainless steel wire as a core filament, a 200 D basalt fiber as an inorganic multifilament, and a 400 D aramid 1414 multifilament as an organic multifilament based on the process and parameters in Table 1 and Columns 2-5 of Table 1 (continued).

Example 6 (6 #)

A composite yarn may be produced using a 35 μm stainless steel wire as a core filament, a 200 D glass fiber as an inorganic multifilament, and a 400 D aramid 1414 multifilament as an organic multifilament based on the process and parameters in Table 1 and Columns 2-5 of Table 1 (continued).

Comparative Example 1 (1'#)

A conventional composite clad yarn may be produced using a 20 μm tungsten wire as a core filament, and feeding a 100 D glass fiber and a 200 D ultra-high molecular weight polyethylene (UHMWPE) multifilament in parallel as the core filament based on the same cladding process as in Example 1 as a comparative example of Example 1.

Comparative Example 2 (2'#)

A conventional composite clad yarn may be produced using a 25 μm tungsten wire as a core filament, and feeding a 100 D glass fiber and a 200 D ultra-high molecular weight polyethylene (UHMWPE) multifilament in parallel as the core filament based on the same cladding process as in Example 2 as a comparative example of Example 2.

TABLE 1

Implementation process and product test results of Examples 1-6 and Comparative Examples 1-2

| Example | Core filament and fineness | Tension of core filament/cN | Inorganic multifilament and specifications/D | Tension of inorganic multifilament/cN | Concentration and time of dipping | Oven temperature and processing time + cooling temperature |
|---|---|---|---|---|---|---|
| 1# | Tungsten wire (20 μm) | 8 cN | 100 D | 4.35 cN | 25%, 0.5 S | 100° C., 4.19 S, 20° C. |
| 2# | Tungsten wire (25 μm) | 9 cN | 100 D | 4.35 cN | 30%, 0.7 S | 108° C., 4.19 S, 15° C. |
| 3# | Tungsten wire (30 μm) | 9 cN | 200 D | 5.30 cN | 30%, 0.7 S | 110° C., 4.19 S, 10° C. |
| 4# | Tungsten wire (10 μm) | 7 cN | 100 D | 4.0 cN | 20%, 1.2 S | 100° C., 5.38 S, 20° C. |
| 5# | Stainless steel (60 μm) | 12 cN | 200 D | 5.30 cN | 45%, 0.5 S | 110° C., 4.19 S, 10° C. |
| 6# | Stainless steel (35 μm) | 9 cN | 200 D | 5.30 cN | 30%, 0.7 S | 110° C., 4.19 S, 10° C. |
| 1' # | Tungsten wire (20 μm) | / | 100 D | / | / | / |
| 2' # | Tungsten wire (25 μm) | / | 100 D | / | / | / |

| Example | Organic multifilament and specifications/D | Tension of organic multifilament | Cladding process and parameters | Fineness of finished composite yarn/tex | Weaving process | Measured cut-resistant value/N | Cut-resistant grade |
|---|---|---|---|---|---|---|---|
| 1# | 200 D | 4.76 cN | Nylon 50D (S600 T/m) | 47.5 tex | 18 G | 23.1 | E |
| 2# | 200 D | 4.76 cN | Nylon 30D (S600 T/m) →cotton polyester short fiber blended yarn 32 Ne (twist coefficient 260, Z800 T/m) | 51.5 tex | 18 G | 27.6 | E |
| 3# | 200 D | 4.76 cN | Pure cotton yarn 32 Ne (twist coefficient 340, Z600 T/m) →nylon 30 D (S800 T/m) | 66.2 tex | 18 G | 31.3 | F |
| 4# | 200 D | 4.5 cN | Nylon 50 D (S600 T/m) | 43.3 tex | 18 G | 15.7 | D |
| 5# | 400 D | 5.78 cN | Nylon 70 D (S400 T/m) →polyester acrylic cotton blended yarn 60 Ne (twist coefficient 420, Z400 T/m) | 72.2 tex | 13 G | 22.8 | E |

TABLE 1-continued

| Implementation process and product test results of Examples 1-6 and Comparative Examples 1-2 | | | | | | | |
|---|---|---|---|---|---|---|---|
| 6# | 400 D | 4.76 cN | Nylon 70 D (Z500 T/m) →pure wool yarn 80 Ne (twist coefficient 260, S600 T/m) | 64.7 tex | 13 G | 15.6 | D |
| 1' # | 200 D | / | Nylon 50 D(S400 T/m) | 46.7 tex | 18 G | 21.02 | C |
| 2' # | 200 D | / | Nylon 30 D (S600 T/m) →cotton polyester short fiber blended yarn 32 Ne (twist coefficient 300, Z800 T/m) | 50.8 tex | 18 G | 23.37 | E |

In the above-mentioned Examples 1-6 and comparative examples 1'# and 2'# of the examples 1-2 in the present disclosure, after the cut-resistant composite yarn is produced by the above-mentioned process, the composite yarn and the spandex filament of the same specifications may be fed side by side, and a cut-resistant glove liner may be woven using a 18G/13G knitting machine. The cut-resistant glove liner may be tested using the EN388 standard. The cut-resistant value and grade may be as described in Table 1 (continued), and the cut-resistant grade may reach D grade or above.

With comparison of the cut-resistant values of the products of Examples 1-2 and the comparative examples thereof in the Table 1, it can be seen that under the same comparative conditions, the cut resistance of the cut-resistant composite yarn products in the present disclosure may be improved by 9.0% and 15.3% respectively.

Figure 9:
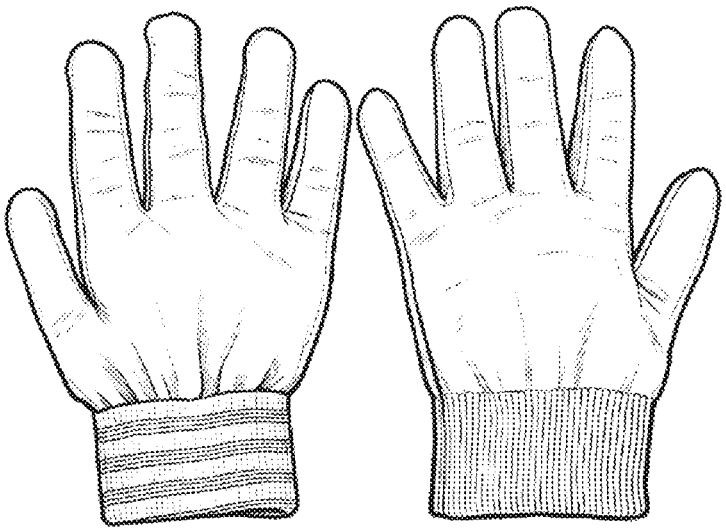
FIG. 9 is an effect diagram illustrating an exemplary bending resistance test of a liner of a cut-resistant glove processed according to an embodiment of the present disclosure and a comparative process.

In addition, the applicant also tested the bending resistance of the cut-resistant glove liner by wearing the glove liners of Example 1-2 and Comparative Example 1-2 on the tester's left hand and right hand respectively. After making fists continuously for 30 minutes, it was found that the bending resistance of the glove liner of the Comparative Example (left side in FIG. 9) and the bending resistance of the glove liner of the Example (right side in FIG. 9) had obvious differences, and the cut-resistant glove liner of the Comparative Example, especially on the finger surfaces, had more and deeper creases, as the tungsten wire was difficult to recover after continuous bending. Compared with the Comparative Examples, the bending resistance of the cut-resistant glove liner of the embodiment of the present disclosure was better, and the cut-resistant glove liner had fewer shallow creases on the finger surfaces.

The above embodiments are intended only to illustrate the technical solutions of the present disclosure, not to limit the present disclosure; although the present disclosure is described in detail with reference to the foregoing embodiments, for those having ordinary skills in the art, modifications may be made to the technical solutions described in the foregoing embodiments, or equivalent replacements may be made for some of the technical features; however, such modifications or replacements do not make the essence of the corresponding technical solutions depart from the spirit and scope of the technical solutions of the embodiments in the present disclosure.

What is claimed is:

1. A composite yarn, comprising:

a core filament located at a core of the composite yarn;

a first multifilament covering in parallel a peripheral surface of the core filament, wherein the first multifilament covering in parallel the peripheral surface of the core filament means that a length extension direction of the first multifilament and a length extension direction of the core filament are the same and parallel to each other;

a water-based adhesive distributed on a surface and inside of the first multifilament, wherein the water-based adhesive on the surface of the first multifilament forms a water-based adhesive layer, the water-based adhesive includes water-based polyurethane emulsion or polyacrylate emulsion, and a concentration of the water-based adhesive is within a range of 20-50 wt %;

a second multifilament uniformly covering in parallel a peripheral surface of the water-based adhesive layer, wherein the second multifilament covering in parallel the peripheral surface of the water-based adhesive layer means that a length extension direction of the second multifilament and the length extension direction of the first multifilament are the same and parallel to each other; and a double-clad structure layer covering an outer side of the second multifilament, wherein the double-clad structure layer is a clad structure of short fiber yarns, a clad structure of filaments, or a clad structure of short fiber yarns and filaments, and two layers of clad yarns of the double-clad structure layer are twisted in opposite directions;

both the first multifilament and the second multifilament are organic multifilaments or inorganic multifilaments;

the second multifilament is selected from a group consisting of ultra-high molecular weight polyethylene (UHMWPE), high-strength and low-elongation polyester, aramid 1414, or high-strength vinylon; and a fineness of the core filament is within a range of 10-60 μm.

2. The composite yarn of claim 1, wherein the core filament includes metal fiber monofilaments, organic fiber filaments or inorganic fiber filaments.

3. The composite yarn of claim 1, wherein the first multifilament is an inorganic multifilament, the inorganic multifilament is a glass fiber multifilament or a basalt fiber multifilament, the second multifilament is a high-strength and low-elongation organic multifilament formed by high-strength and low-elongation polyester and aramid 1414, and a fineness of the high-strength and low-elongation organic multifilament is within a range of 150-400D.

4. The composite yarn of claim 3, wherein the inorganic multifilaments are inorganic fiber multifilaments, and a fineness of the inorganic fiber multifilaments is within a range of 50-200 D.

5. The composite yarn of claim 1, wherein a linear density of the composite yarn is within a range of 33.3 tex-72.2 tex.

6. The composite yarn of claim 1, wherein the short fiber yarns of the clad structure of short fiber yarns are selected from any pure spinning yarn or any two or more blended yarns of cotton, hemp, wool, polyester, nylon, and acrylic fibers; and a fineness of the short fiber yarns is within a range of 32-80 Ne, a twist coefficient is within a range of 260-420, and a covering twist is within a range of 400-800 twists/meter.

7. The composite yarn of claim 6, wherein the filaments of the clad structure of filaments are nylon filaments and/or polyester filaments; and a fineness of the filaments is within a range of 30-100 D, and a covering twist is within a range of 400-800 twists/meter.

8. The composite yarn of claim 1, wherein the composite yarn is obtained by performing double cladding on a second clad filament bundle; the second clad filament bundle is obtained by covering a composite monofilament with the second multifilament; the composite monofilament is obtained by performing a dipping treatment, post-processing, and a drying and cooling treatment on a first clad filament bundle; and the first clad filament bundle is formed by covering in parallel a peripheral surface of the core filament with the first multifilament; wherein the dipping treatment is performed based on dipping parameters, and the dipping parameters include water-based adhesive parameters and dipping treatment time; and the post-processing is performed based on post-processing parameters; and the post-processing parameters include at least a post-processing mode.

9. The composite yarn of claim 8, wherein when the second multifilament covers the composite monofilament, a tension of the second multifilament is within a third preset tension range, and a tension of the composite monofilament is within a fourth preset tension range; and the third preset tension range and the fourth preset tension range are determined based on specification parameters of the core filament, the first multifilament and the second multifilament.

10. The composite yarn of claim 9, wherein the dipping parameters are related to the specification parameters of the core filament and the first multifilament;

the post-processing parameters are related to the specification parameters of the core filament and the first multifilament, and the dipping parameters; and the third preset tension range and the fourth preset tension range are determined based on the dipping parameters, the post-processing parameters, drying parameters and cooling parameters.

11. The composite yarn of claim 10, wherein the third preset tension range and the fourth preset tension range are determined based on a plurality of reference third preset tension ranges and a plurality of reference fourth preset tension range;

the plurality of reference third preset tension ranges and the plurality of reference fourth preset tension ranges correspond to one or more third correlation vectors;

the one or more third correlation vectors are determined through a third vector database based on third target vectors; and the third target vectors are constructed based on the specification parameters of the core filament, the first multifilament and the second multifilament, the dipping parameters, the post-processing parameters, the drying parameters, and the cooling parameters.

12. The composite yarn of claim 11, wherein the third preset tension range is determined by performing weighted summation on the plurality of reference third preset tension ranges corresponding to the plurality of third correlation vectors; and in response to that the third preset tension range is determined by performing weighted summation on the plurality of reference third preset tension ranges corresponding to the plurality of third correlation vectors, a weight of each reference third preset tension range is positively related to an abnormal correlation distance of the third correlation vector corresponding to the third preset tension range during weighting;

the fourth preset tension range is determined by performing weighted summation on the plurality of reference fourth preset tension ranges corresponding to the plurality of third correlation vectors; and in response to that the third preset tension range is determined by performing weighted summation on the plurality of reference fourth preset tension ranges corresponding to the plurality of third correlation vectors, a weight of each reference fourth preset tension range is positively related to an abnormal correlation distance of the third correlation vector corresponding to the fourth preset tension range during weighting; and the abnormal correlation distance is used to reflect a time interval between a time corresponding to the third correlation vector and a time of a latest abnormal accident.

13. The composite yarn of claim 1, wherein the composite yarn is made based on a device for processing the composite yarn, and the device for processing the composite yarn includes a frame and a plurality of sets of processing devices arranged side by side on the frame; each set of processing devices includes a first guide composite mechanism arranged at one end of the frame, a dipping mechanism arranged below an output end of the first guide composite mechanism, a drying and cooling mechanism arranged in a middle of the frame and located downstream of the dipping mechanism, a second guide composite mechanism arranged at an output end of the drying and cooling mechanism, and a cladding mechanism arranged at an output end of the second guide composite mechanism;

the first guide composite mechanism includes a first feed roller unit connected with the frame, a first main godet wheel unit arranged at an inner side of the first feed roller unit, and a first auxiliary godet wheel unit arranged at an inlet end of the first main godet wheel unit; and the first main godet wheel unit includes a first vertical screw connected with the frame, a first L-shaped bracket connected with a top of the first vertical screw, a first horizontal screw connected with the first L-shaped bracket, and a first V-shaped godet wheel arranged on the first horizontal screw.

14. The composite yarn of claim 1, wherein there is an included angle between a grain orientation of constituent filaments in the second multifilament and a grain orientation of constituent filaments in the first multifilament, and the included angle is within a range of 30°-90°.

15. The composite yarn of claim 14, wherein the core filament is made of metal material, the first multifilament is made of inorganic fiber multifilament, and the second multifilament is made of high-strength and low-elongation organic multifilament.

16. The composite yarn of claim 15, further comprising: an insulating layer made of insulating materials covering an outer side of the double-clad structure layer to improve an insulation of the composite yarn, wherein the insulating materials include at least one of polyethylene, nylon and polyester.

* * * * *